US010392708B2

(12) United States Patent
Gong et al.

(10) Patent No.: US 10,392,708 B2
(45) **Date of Patent: *Aug. 27, 2019**

(54) METALIZED PLASTIC ARTICLES AND METHODS THEREOF

(71) Applicant: BYD COMPANY LIMITED, Shenzhen, Guangdong (CN)

(72) Inventors: Qing Gong, Guangdong (CN); Liang Zhou, Guangdong (CN); Weifeng Miao, Guangdong (CN); Xiong Zhang, Guangdong (CN)

(73) Assignee: BYD COMPANY LIMITED, Shenzhen (CN)

( * ) Notice: Subject to any disclaimer, the term of this patent is extended or adjusted under 35 U.S.C. 154(b) by 912 days.

This patent is subject to a terminal disclaimer.

(21) Appl. No.: 14/576,950

(22) Filed: Dec. 19, 2014

(65) Prior Publication Data

US 2015/0104668 A1 Apr. 16, 2015

Related U.S. Application Data

(63) Continuation of application No. 13/350,161, filed on Jan. 13, 2012, now Pat. No. 8,920,936, which is a continuation of application No. 13/103,859, filed on May 9, 2011, now Pat. No. 9,435,035, which is a continuation-in-part of application No. 12/842,407, filed on Jul. 23, 2010, now abandoned.

(30) Foreign Application Priority Data

Jan. 15, 2010 (CN) ..... 2010 1 0044447

(51) Int. Cl.

| | |
|---|---|
| ***C23C 28/02*** | (2006.01) |
| ***C23C 18/20*** | (2006.01) |
| ***C23C 18/16*** | (2006.01) |
| ***B05D 1/36*** | (2006.01) |
| ***B05D 3/06*** | (2006.01) |
| ***B05D 7/00*** | (2006.01) |
| ***C23C 18/50*** | (2006.01) |
| ***C25D 5/56*** | (2006.01) |

(52) U.S. Cl.

CPC ..... *C23C 28/021* (2013.01); *B05D 1/36* (2013.01); *B05D 3/06* (2013.01); *B05D 7/54* (2013.01); *C23C 18/1641* (2013.01); *C23C 18/20* (2013.01); *C23C 18/204* (2013.01); *C23C 18/2006* (2013.01); *C23C 18/50* (2013.01); *C25D 5/56* (2013.01); *Y10T 428/12569* (2015.01)

(58) Field of Classification Search

None

See application file for complete search history.

(56) References Cited

U.S. PATENT DOCUMENTS

| | | | |
|---|---|---|---|
| 3,056,881 | A | 10/1962 | Schwarz |
| 3,226,256 | A | 12/1965 | Schneble, Jr. et al. |
| 3,234,044 | A | 2/1966 | Andes et al. |
| 3,305,460 | A | 2/1967 | Lacy |
| 3,546,011 | A | 12/1970 | Knorre et al. |
| 3,627,576 | A | 12/1971 | Knorre et al. |
| 3,799,802 | A | 3/1974 | Schneble, Jr. et al. |
| 3,804,740 | A | 4/1974 | Welch |
| 3,846,460 | A | 11/1974 | Fite, Jr. |
| 4,087,586 | A | 5/1978 | Feldstein |
| 4,159,414 | A | 6/1979 | Suh et al. |
| 4,416,932 | A | 11/1983 | Nair |
| 4,426,442 | A | 1/1984 | Molenaar et al. |
| 4,550,140 | A | 10/1985 | Rimsa et al. |
| 4,555,414 | A | 11/1985 | Hoover et al. |
| 4,585,490 | A | 4/1986 | Raffel et al. |
| 4,767,665 | A | 8/1988 | Seeger |
| 4,772,496 | A | 9/1988 | Maeda et al. |
| 4,810,663 | A | 3/1989 | Raffel et al. |
| 4,841,099 | A | 6/1989 | Epstein et al. |
| 4,853,252 | A | 8/1989 | Frankel et al. |
| 4,894,115 | A | 1/1990 | Eichelberger et al. |
| 5,082,739 | A | 1/1992 | Roy et al. |
| 5,096,882 | A | 3/1992 | Kato et al. |
| 5,153,023 | A | 10/1992 | Orlowski et al. |

(Continued)

FOREIGN PATENT DOCUMENTS

| | | | |
|---|---|---|---|
| CN | 1370806 | A | 9/2002 |
| CN | 1444632 | A | 9/2003 |

(Continued)

OTHER PUBLICATIONS

Ahmed et al., "Laser induced structural and transport properties change in Cu—Zn ferrites", *J. Mater. Sci.*, vol. 42, 2007, pp. 4098-4109.

Boone, "Metallization and Structuring of Injection Molded Parts with Integrated Circuit Traces", *Electroplating*, D-88348 Saulgau, vol. 85, No. 4, 1994, pp. 1307-1319.

DeSilva et al., "A New Technique to Generate Conductive Paths in Dielectric Materials", *Mat. Res. Soc. Symp. Proc.*, vol. 323, 1994, pp. 97-102.

Eber-Gred, "Synthesis of Copper-Based Transparent Conductive Oxides with Delafossite Structure via Sol-Gel Processing", Dissertation, Würzburg, 2010 (208 pages).

(Continued)

*Primary Examiner* — Adam Krupicka

(57) ABSTRACT

Metalized plastic substrates, and methods thereof are provided herein. The method includes providing a plastic having a plurality of accelerators dispersed in the plastic. The accelerators have a formula ABO3, wherein A is one or more elements selected from Groups 9, 10, and 11 of the Periodic Table of Elements, B is one or more elements selected from Groups 4B and 5B of the Periodic Table of Elements, and O is oxygen. The method includes the step of irradiating a surface of plastic substrate to expose at least a first accelerator. The method further includes plating the irradiated surface of the plastic substrate to form at least a first metal layer on the at least first accelerator, and then plating the first metal layer to form at least a second metal layer.

8 Claims, 4 Drawing Sheets

(56) References Cited

U.S. PATENT DOCUMENTS

| | | | |
|---|---|---|---|
| 5,162,144 | A | 11/1992 | Brown et al. |
| 5,198,096 | A | 3/1993 | Foust et al. |
| 5,281,447 | A | 1/1994 | Brady et al. |
| 5,378,508 | A | 1/1995 | Castro et al. |
| 5,422,383 | A | 6/1995 | Takahashi et al. |
| 5,576,073 | A | 11/1996 | Kickelhain |
| 5,585,602 | A | 12/1996 | Bernstein |
| 5,599,592 | A | 2/1997 | Laude |
| 5,702,584 | A | 12/1997 | Goenka et al. |
| 5,838,063 | A | 11/1998 | Sylvester |
| 5,856,395 | A | 1/1999 | Tanisho et al. |
| 5,955,179 | A | 9/1999 | Kickelhain et al. |
| 6,194,032 | B1 | 2/2001 | Svedberg et al. |
| 6,198,197 | B1 | 3/2001 | Yamanouchi et al. |
| 6,277,319 | B2 | 8/2001 | Hardgrove et al. |
| 6,417,486 | B1 | 7/2002 | Reil et al. |
| 6,696,173 | B1 | 2/2004 | Naundorf et al. |
| 6,706,785 | B1 | 3/2004 | Fu |
| 6,743,345 | B2 | 6/2004 | Belouet et al. |
| 6,818,678 | B2 | 11/2004 | Yamaguchi et al. |
| 6,951,816 | B2 | 10/2005 | Nopper et al. |
| 7,060,421 | B2 | 6/2006 | Naundorf et al. |
| 7,576,140 | B2 | 8/2009 | Tamaki et al. |
| 8,841,000 | B2 | 9/2014 | Gong et al. |
| 8,846,151 | B2 | 9/2014 | Gong et al. |
| 8,920,936 | B2 | 12/2014 | Gong et al. |
| 2002/0046996 | A1 | 4/2002 | Reil et al. |
| 2002/0076911 | A1 | 6/2002 | Lin |
| 2003/0031803 | A1 | 2/2003 | Belouel et al. |
| 2003/0042144 | A1 | 3/2003 | Isono et al. |
| 2003/0134558 | A1 | 7/2003 | Lien et al. |
| 2004/0010665 | A1 | 1/2004 | Agarwal et al. |
| 2004/0026254 | A1 | 2/2004 | Hupe et al. |
| 2004/0101665 | A1 | 5/2004 | Seita et al. |
| 2004/0241422 | A1 | 12/2004 | Naundorf et al. |
| 2005/0023248 | A1 | 2/2005 | Ichimura et al. |
| 2005/0064711 | A1 | 3/2005 | Kliesch et al. |
| 2005/0069688 | A1 | 3/2005 | Kliesch et al. |
| 2005/0269740 | A1 | 12/2005 | Guns et al. |
| 2006/0145782 | A1 | 7/2006 | Liu et al. |
| 2006/0286365 | A1 | 12/2006 | Lee et al. |
| 2007/0014975 | A1 | 1/2007 | Ota |
| 2007/0075050 | A1 | 4/2007 | Heyl |
| 2007/0154561 | A1 | 7/2007 | Takeda et al. |
| 2007/0247822 | A1 | 10/2007 | Naundorf |
| 2008/0015320 | A1 | 1/2008 | Lee |
| 2008/0092806 | A1 | 4/2008 | West et al. |
| 2009/0292048 | A1 | 11/2009 | Li et al. |
| 2009/0292051 | A1 | 11/2009 | Li et al. |
| 2010/0021657 | A1 | 1/2010 | Lochtman et al. |
| 2010/0080958 | A1 | 4/2010 | Goelling |
| 2010/0266752 | A1 | 10/2010 | Tseng et al. |
| 2011/0048783 | A1 | 3/2011 | Yu |
| 2011/0177359 | A1 | 7/2011 | Gong et al. |
| 2011/0212344 | A1 | 9/2011 | Gong et al. |
| 2011/0212345 | A1 | 9/2011 | Gong et al. |
| 2011/0251326 | A1 | 10/2011 | Van Harlingsveldt et al. |
| 2011/0281135 | A1 | 11/2011 | Gong et al. |
| 2012/0045658 | A1 | 2/2012 | Gong et al. |
| 2012/0114968 | A1 | 5/2012 | Gong et al. |
| 2012/0121928 | A1 | 5/2012 | Gong et al. |
| 2014/0356645 | A1 | 12/2014 | Gong et al. |

FOREIGN PATENT DOCUMENTS

| | | | |
|---|---|---|---|
| CN | 1518850 | A | 8/2004 |
| CN | 1523138 | A | 8/2004 |
| CN | 1542547 | A | 11/2004 |
| CN | 1666583 | A | 9/2005 |
| CN | 1238572 | C | 1/2006 |
| CN | 101113527 | A | 1/2008 |
| CN | 101268134 | A | 9/2008 |
| CN | 101299910 | A | 11/2008 |
| CN | 101394710 | A | 3/2009 |
| CN | 101634018 | A | 1/2010 |
| CN | 101654564 | A | 2/2010 |
| CN | 102071411 | A | 5/2011 |
| CN | 102277569 | A | 12/2011 |
| CN | 101747650 | B | 1/2012 |
| DE | 19852776 | A1 | 5/2000 |
| EP | 0230128 | A2 | 7/1987 |
| EP | 0298345 | A2 | 1/1989 |
| EP | 0311274 | A2 | 4/1989 |
| EP | 1367872 | A2 | 12/2003 |
| EP | 1650249 | A1 | 4/2006 |
| EP | 1062850 | B1 | 5/2007 |
| JP | 51-80347 | | 7/1976 |
| JP | 52-079772 | | 7/1977 |
| JP | 58-018932 | | 2/1983 |
| JP | 61-185555 | | 8/1986 |
| JP | 2-285076 | | 11/1990 |
| JP | 2-305969 | | 12/1990 |
| JP | 3-52945 | | 3/1991 |
| JP | 2001-271171 | | 10/2001 |
| JP | 2004-238471 | A | 8/2004 |
| JP | 2006-124701 | | 5/2006 |
| JP | 2007-27312 | | 2/2007 |
| RU | 2188879 | C2 | 9/2002 |
| RU | 2192715 | C1 | 11/2002 |
| WO | WO 98/44165 | A1 | 10/1998 |
| WO | WO 00/15007 | A1 | 3/2000 |
| WO | WO 00/35259 | A2 | 6/2000 |
| WO | WO 03/005784 | A2 | 1/2003 |
| WO | WO 2008/064863 | A1 | 6/2008 |
| WO | WO 2009/009070 | A1 | 1/2009 |
| WO | WO 2009/141800 | A2 | 11/2009 |
| WO | WO 2010/022641 | A1 | 3/2010 |
| WO | WO 2011/072506 | A1 | 6/2011 |

OTHER PUBLICATIONS

Esser et al., "Laser Assisted Techniques for Patterning of Conductive Tracks on Molded Interconnect Devices", Proceedings of the Technical Program, 1998, pp. 225-233.

Gesemann et al., "Conducting paths: Laser beam sets germs, reinforced plating—Part 2", *PCB electroplating*, vol. 44, No. 7, 1990, pp. 329-331.

Marquardt et al., "Crystal chemistry and electrical properties of the delafossite structure", *Thin Solid Films*, vol. 496, 2006 (4 pages).

Shafeev, "Laser-assisted activation of dielectrics for electroless metal plating", *Appl. Phys. A.*, vol. 67, 1998, pp. 303-311.

Notice of Allowance dated Jan. 24, 2006, issued in U.S. Appl. No. 10/751,111 (13 pages).

Non-final Office Action dated Nov. 26, 2012, issued in related U.S. Appl. No. 13/103,859 (13 pages).

Final Office Action dated Jul. 12, 2013, issued in related U.S. Appl. No. 13/103,859 (15 pages).

Examiner's Answer to Appeal Brief dated Jan. 29, 2014, issued in related U.S. Appl. No. 13/103,859 (13 pages).

Non-final Office Action dated May 31, 2012, issued in U.S. Appl. No. 13/350,161 (12 pages).

Final Office Action dated Jan. 16, 2013, issued in U.S. Appl. No. 13/350,161 (8 pages).

Non-final Office Action dated Jul. 1, 2013, issued in U.S. Appl. No. 13/350,161 (9 pages).

Non-final Office Action dated Mar. 11, 2014, issued in U.S. Appl. No. 13/350,161 (10 pages).

Notice of Allowance dated Aug. 28, 2014, issued in U.S. Appl. No. 13/350,161 (6 pages).

Non-final Office Action dated Apr. 1, 2013, issued in related U.S. Appl. No. 12/950,904 (17 pages).

Final Office Action dated Jul. 22, 2013, issued in related U.S. Appl. No. 12/950,904 (14 pages).

Non-final Office Action dated Apr. 3, 2014, issued in related U.S. Appl. No. 12/950,904 (13 pages).

Final Office Action dated Aug. 18, 2014, issued in U.S. Appl. No. 12/950,904 (15 pages).

Non-final Office Action dated Nov. 29, 2012, issued in related U.S. Appl. No. 13/186,280 (19 pages).

Final Office Action dated Jul. 11, 2013, issued in related U.S. Appl. No. 13/186,280 (21 pages).

(56) References Cited

OTHER PUBLICATIONS

Notice of Allowance dated Jun. 5, 2014, issued in related U.S. Appl. No. 13/186,280 (11 pages).
Non-final Office Action dated May 25, 2012, issued in related U.S. Appl. No. 13/354,512 (12 pages).
Final Office Action dated Jan. 7, 2013, issued in related U.S. Appl. No. 13/354,512 (13 pages).
Non-final Office Action dated Jun. 25, 2013, issued in related U.S. Appl. No. 13/354,512 (12 pages).
Non-final Office Action dated Nov. 26, 2013, issued in related U.S. Appl. No. 13/354,512 (7 pages).
Notice of Allowance dated May 21, 2014, issued in related U.S. Appl. No. 13/354,512 (6 pages).
Non-final Office Action dated Apr. 9, 2013, issued in related U.S. Appl. No. 13/128,401 (39 pages).
Final Office Action dated Aug. 14, 2013, issued in related U.S. Appl. No. 13/128,401 (39 pages).
Non-final Office Action dated Oct. 1, 2014, issued in related U.S. Appl. No. 13/128,401 (30 pages).
Chinese First Office Action dated Jun. 16, 2011, issued in Chinese Application No. 200910261216.2 (10 pages).
Chinese First Office Action dated Jul. 28, 2011, issued in Chinese Application No. 200910238957.9 (16 pages).
Chinese First Office Action dated Jul. 28, 2011, issued in Chinese Application No. 201010044447.0 (8 pages).
Chinese First Office Action dated Aug. 4, 2011, issued in Chinese Application No. 201010117125.4 (9 pages).
Chinese First Office Action dated Aug. 5, 2011, issued in Chinese Application No. 201010260236.0 (9 pages).
Chinese First Office Action dated Aug. 1, 2012, issued in Chinese Application No. 201110202091.3 (8 pages).
Chinese First Office Action dated Aug. 1, 2012, issued in Chinese Application No. 201110202369.7 (8 pages).
Chinese First Office Action dated Sep. 5, 2012, issued in Chinese Application No. 201110202402.6 (8 pages).
European Examination Report dated Mar. 26, 2013, issued in European Application No. 10193044.4 (4 pages).
European Examination Report dated Oct. 1, 2013, issued in European Application No. 10827682.5 (5 pages).
European Examination Report dated Oct. 1, 2013, issued in European Application No. 13151234.5 (5 pages).
Extended European Search Report dated Mar. 31, 2011, issued in European Application No. 10193044.4 (11 pages).
Extended European Search Report dated Jun. 25, 2012, issued in European Application No. 10827682.5 (14 pages).
Extended European Search Report dated Apr. 5, 2013, issued in European Application No. 13151234.5 (5 pages).
Extended European Search Report dated Apr. 5, 2013, issued in European Application No. 13151235.2 (5 pages).
Extended European Search Report dated Apr. 5, 2013, issued in European Application No. 13151236.0 (5 pages).
Extended European Search Report dated Oct. 7, 2013, issued in European Application No. 13177928.2 (7 pages).
Partial European Search Report dated Feb. 7, 2011, issued in European Application No. 10193044.4 (6 pages).
Japanese Office Action dated Sep. 17, 2013, issued in Japanese Application No. 2012-505042 (6 pages).
Japanese Office Action dated Sep. 17, 2013, issued in Japanese Application No. 2012-506325 (6 pages).
Japanese Office Action dated Sep. 17, 2013, issued in Japanese Application No. 2012-506332 (7 pages).
Korean Office Action dated Mar. 15, 2013, issued in Korean Application No. 10-2011-7020318 (9 pages).
Korean Office Action dated Mar. 15, 2013, issued in Korean Application No. 10-2011-7020319 (7 pages).
Korean Office Action dated Mar. 15, 2013, issued in Korean Application No. 10-2011-7020337 (9 pages).
Korean Office Action dated Jul. 1, 2013, issued in Korean Application No. 10-2011-7020318 (4 pages).
Korean Office Action dated Jul. 1, 2013, issued in Korean Application No. 10-2011-7020319 (6 pages).
Korean Office Action dated Jul. 1, 2013, issued in Korean Application No. 10-2011-7020337 (5 pages).
Korean Office Action dated Jul. 1, 2013, issued in Korean Application No. 10-2013-7012557 (8 pages).
Korean Office Action dated Jul. 1, 2013, issued in Korean Application No. 10-2013-7013356 (8 pages).
Korean Office Action dated Jul. 1, 2013, issued in Korean Application No. 10-2013-7013357 (4 pages).
Korean Office Action dated Jul. 1, 2013, issued in Korean Application No. 10-2013-7013358 (4 pages).
Korean Office Action dated Oct. 18, 2013, issued in Korean Application No. 10-2011-7020319 (10 pages).
Korean Office Action dated Oct. 18, 2013, issued in Korean Application No. 10-2011-7020337 (8 pages).
Korean Office Action dated Oct. 18, 2013, issued in Korean Application No. 10-2013-7012557 (7 pages).
Korean Office Action dated Oct. 18, 2013, issued in Korean Application No. 10-2013-7013356 (6 pages).
Korean Office Action dated Oct. 18, 2013, issued in Korean Application No. 10-2013-7013357 (9 pages).
Korean Office Action dated Oct. 18, 2013, issued in Korean Application No. 10-2013-7013358 (10 pages).
PCT International Search Report and Written Opinion dated Sep. 23, 2010, issued in International Application No. PCT/CN2010/072055 (12 pages).
PCT International Search and Written Opinion dated Oct. 28, 2010, issued in International Application No. PCT/CN2010/075232 (12 pages).
PCT International Search and Written Opinion dated Feb. 24, 2011, issued in International Application No. PCT/CN2010/078700 (15 pages).
PCT International Search and Written Opinion dated Nov. 24, 2011, issued in International Application No. PCT/CN2011/078487 (12 pages).

METALIZED PLASTIC ARTICLES AND METHODS THEREOF

CROSS-REFERENCE TO RELATED APPLICATION

This application is a continuation application of U.S. patent application Ser. No. 13/350,161, filed on Jan. 13, 2012, which is a continuation application of U.S. patent application Ser. No. 13/103,859, filed on May 9, 2011, which is a continuation-in-part application of U.S. patent application Ser. No. 12/842,407, filed on Jul. 23, 2010, which claims the priority and benefit of Chinese Patent Application No. CN201010044447.0, filed with the State Intellectual Property Office, P. R. China, on Jan. 15, 2010. All of the above-referenced applications are incorporated herein by reference.

FIELD OF THE PRESENT DISCLOSURE

The present disclosure relates generally to plastic articles. In more particularity, the present disclosure relates to a surface metallization method for the same.

BACKGROUND OF THE PRESENT DISCLOSURE

Metalization, also spelled metallization, is the process in which a non-metal substrate, such as a plastic, is coated, deposited, or otherwise provided, with a metallic layer or plating. Without wishing to be bound by the theory, Applicant believes that the metalization process may improve the substrates' ability to transmit, or otherwise transfer, electric and/or magnetic signals.

SUMMARY OF THE DISCLOSURE

In accordance with various illustrative embodiments hereinafter disclosed are methods of metalizing a plastic substrate. The method may include providing a plastic substrate having a plastic and a plurality of accelerators dispersed in the plastic. The accelerators may have a formula, $ABO_3$, wherein A is one or more elements selected from Groups 9, 10, 11 of the Periodic Table of Elements and optionally one or more elements selected from Groups 1 and 2, and the lanthanide series of the Periodic Table of Elements, B is one or more elements selected from Groups 4B and 5B of the Periodic Table of Elements, and O is oxygen. The method may include the step of irradiating a surface of a plastic substrate, optionally by a laser irradiation, to expose at least a first accelerator. The method may further include plating the irradiated surface of the plastic substrate to form at least a first metal layer on the at least first accelerator, and then plating the first metal layer to form at least a second metal layer.

In accordance with another illustrative embodiment hereinafter disclosed are plastic articles comprising: a plastic substrate having a plastic and a plurality of accelerators plated with at least first and second metal layers, wherein the accelerators having a formula, $ABO_3$, wherein A is one or more elements selected from Groups 9, 10, 11 of the Periodic Table of Elements and optionally one or more elements selected from Groups 1 and 2, and lanthanide series of the Periodic Table of Elements, B is one or more elements selected from Groups 4B and 5B of the Periodic Table of Elements, and O is oxygen.

While the metalized plastic substrates and methods thereof will be described in connection with various preferred illustrative embodiments, it will be understood that it is not intended to limit the metalized plastics and methods thereof to those embodiments. On the contrary, it is intended to cover all alternatives, modifications, and equivalents as may be included within the spirit and scope of the invention as defined by the appended claims.

BRIEF DESCRIPTION OF THE DRAWINGS

The plastic articles and methods thereof of the present disclosure may be understood by reference to the disclosure herein taken in conjunction with the accompanying drawing figures, in which.

DETAILED DESCRIPTION

Figure 1:
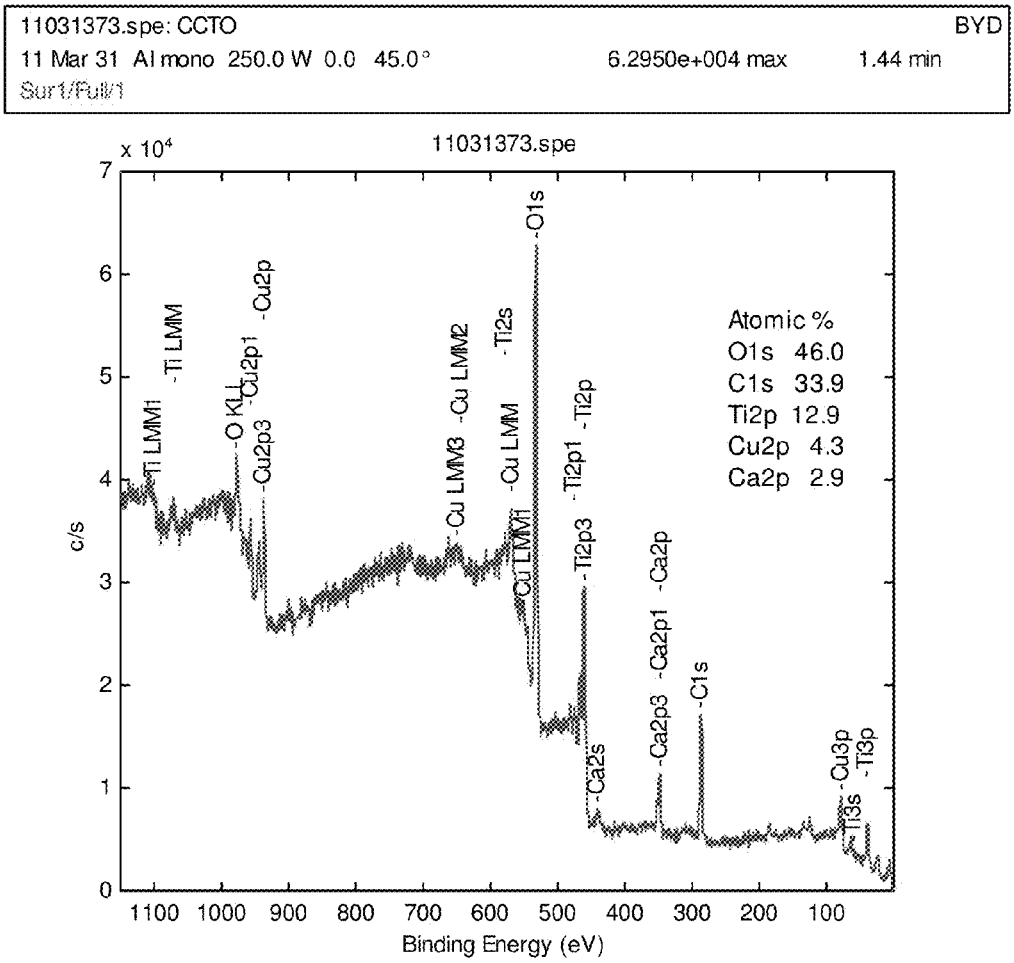
FIG. 1 is an XPS pattern of an accelerator according to an embodiment of the present disclosure.

In an illustrative, non-limiting, embodiment of the present disclosure, a method of metalizing a plastic substrate is provided. The method may include providing a plastic substrate having a plastic and a plurality of accelerators dispersed in the plastic. The accelerators may have a formula, $ABO_3$, wherein A is one or more elements selected from Groups 9, 10, 11 of the Periodic Table of Elements and optionally one or more elements selected from Groups 1 and 2, and lanthanide series of the Periodic Table of Elements, B is one or more elements selected from Groups 4B and 5B of the Periodic Table of Elements, and O is oxygen. The method may include the step of irradiating a surface of plastic substrate, optionally by a laser irradiation, to expose at least a first accelerator. The method may further include plating the irradiated surface of the plastic substrate to form at least a first metal layer on the at least first accelerator, and then plating the first metal layer to form at least a second metal layer.

The Periodic Table of Elements referred to herein is the IUPAC version of the periodic table of elements described in the *CRC Handbook of Chemistry and Physics,* $90^{th}$ Edition, CRC Press, Boca Raton, Fla. (2009-2010).

Accelerators

In an illustrative, non-limiting, embodiment, the accelerators may have a formula of $ABO_3$, wherein A is one or more elements selected from Groups 9, 10, 11 of the Periodic Table of Elements and optionally one or more elements selected from Groups 1 and 2, and lanthanide series of the Periodic Table of Elements; B is one or more elements selected from Groups 4B and 5B of the Periodic Table of Elements; and O is oxygen. For example, A may comprise one element selected from the group consisting of: Cu, Ni, Co, Rh, Pd, Ag, and combinations thereof; and B may comprise one element selected from the group consisting of Ti, Zr, Nb, V and combinations thereof. In a further non-limiting embodiment, the accelerators may have perovskite structures. Particularly suitable accelerators may include: $Ca_xCu_{4-x}Ti_4O_{12}$, $Na_{0.04}Ca_{0.98}Cu_3Ti_4O_{12}$, $La_{0.01}Ca_{0.99}Cu_3Ti_4O_{12}$, $CuNiTi_2O_6$, $CuNbO_3$, $CuTaO_3$ and $CuZrO_3$, wherein $0 \leq x < 4$. Still further suitable accelerators, without limitation, may include $CaCU_3Ti_4O_{12}$, $Na_{0.04}Ca_{0.98}CU_3Ti_4O_{12}$, $La_{0.01}Ca_{0.99}CU_3Ti_4O_{12}$, $CUTiO_3$, $CuNiTi_2O_6$, $CuNbO_3$, $CuTaO_3$, and $CuZrO_3$. Without wishing to be bound by the theory, Applicant believes that perovskite-based compounds with a general formula of $ABO_3$ may favor a direct copper-plating or nickel-plating, and serve to avoid, or otherwise mitigate, plastic degradation.

In a non-limiting embodiment, the average diameter of each accelerator may range from about 20 nanometers to about 100 microns, alternatively from about 50 nanometers to about 10 microns, and alternatively from about 200 nanometers to about 4 microns. The accelerators may be from about 1 wt % to about 40 wt % of the plastic substrate, alternatively from about 1 wt % to about 30 wt %, and alternatively from about 2 wt % to about 15 wt %.

In a further illustrative, non-limiting, embodiment, the accelerators may be uniformly dispersed within the plastic. Without wishing to be bound by the theory, Applicant believes that a uniform dispersion of accelerators in the plastic aides in forming a strong adhesion between the metal layer and the plastic substrate.

Methods of preparing suitable accelerators are generally known. In one non-limiting example, a method for preparing $CaCu_3Ti_4O_{12}$ comprises the steps of: mixing high purity, for example of at least 95% purity, $CaCO_3$, CuO, $TiO_2$ powders within stoichiometric proportion; milling the powders in distilled water for about 2 hours to form a first mixture; calcining the first mixture under a temperature of about 950 degrees centigrade (° C.) for about 2 hours; milling the calcinated first mixture to form a second mixture; drying the second mixture and granulating with polyvinyl alcohol to form a third mixture; pressing the third mixture into a circular sheet under a pressure of about 100 MPa; and sintering the third mixture under a temperature of about 1100° C. for about 6 hours to form the accelerator. Similarly, a method for preparing $Na_{0.04}Ca_{0.98}Cu_3Ti_4O_{12}$ may comprise the steps of: mixing high purity, for example of at least 95% purity, $Na_2CO_3$, $CaCO_3$, CuO powders with stoichiometric proportion; first milling; calcining; second milling; drying granulating; pressing; and sintering.

Plastic

In an illustrative, non-limiting, embodiment, the plastic may be a thermoplastic plastic, or thermoset otherwise called a thermosetting plastic. The thermoplastic plastic may be selected from the group consisting of polyolefin, polyester, polyamide, polyaromatic ether, polyester-imide, polycarbonate (PC), polycarbonate/acrylonitrile-butadiene-styrene composite (PC/ABS), polyphenylene oxide (PPO), polyphenylene sulfide (PPS), polyimide (PI), polysulfone (PSU), poly (ether ether ketone) (PEEK), polybenzimidazole (PBI), liquid crystalline polymer (LCP), and combinations thereof. The polyolefin may be polystyrene (PS), polypropylene (PP), polymethyl methacrylate (PMMA) or acrylonitrile-butadiene-styrene (ABS); the polyester may be polycyclohexylene dimethylene terephthalate (PCT), poly (diallyl isophthalate) (PDAIP), poly(diallyl terephthalate) (PDAP), polybutylene naphthalate (PBN), Poly(ethylene terephthalate) (PET), or polybutylene terephthalate (PBT); the polyamide may be polyhexamethylene adipamide (PA-66), Nylon 69 (PA-69), Nylon 64 (PA-64), Nylon 612 (PA-612), polyhexamephylene sebacamide (PA-610), Nylon 1010 (PA-1010), Nylon 11 (PA-11), Nylon 12 (PA-12), Nylon 8 (PA-8), Nylon 9 (PA-9), polycaprolactam (PA-6), poly(p-phenytene terephthalamide) (PPTA), poly-meta-xylylene adipamide (MXD6), polyhexamethylene terephthalamide (PA6T), and Nylon 9T (PA9T). The thermoset may be one or more members selected from the group consisting of phenolic resin, urea-formaldehyde resin, melamine-formaldehyde resin, epoxy resin, alkyd resin, polyurethane, and combinations thereof.

Dispersion of Accelerator(s) in Plastic

In an illustrative, non-limiting, embodiment, the accelerator(s) may be dispersed within the plastic by any method of mixture or combination, followed, without limitation, by an optional molding process. In various embodiments, the accelerator(s) may become dispersed in the plastic by using an internal mixer, a singer screw extruder, a twin screw extruder or a mixer. In various embodiments, the term "plastic substrate" means a plastic having accelerator(s) disposed, or dispersed, therein. Following, dispersion of the accelerator(s) in the plastic, the plastic substrate may be formed into various kinds of shapes during an injection molding, blow molding, extraction molding, or hot press molding processes.

Additives

In illustrative, non-limiting, embodiments, the plastic substrate may further comprise one or more generally known, and commercially available, additives selected from the group consisting of: an antioxidant; a light stabilizer; a lubricant; and inorganic fillers. In a non-limiting embodiment, the antioxidant may be antioxidant 1098, 1076, 1010, 168 available from Ciba Specialty Chemicals Corporation, located in Switzerland. The antioxidant may be about 0.01 wt % to about 2 wt % of the plastic substrate.

The light stabilizer may be any such commercially available product, including a hindered amine light stabilizer, such as light stabilizer 944 available from Ciba Specialty Chemicals Corporation, located in Switzerland. The light stabilizer may be about 0.01 wt % to about 2 wt % of the plastic substrate.

In a non-limiting embodiment, the lubricant may be selected from the group consisting of: methylpolysiloxanes; EVA waxes formed from ethylene and vinyl acetate; polyethylene waxes; stearates; and combinations thereof. The lubricant may be about 0.01 wt % to about 2 wt % of the plastic substrate.

In a non-limiting embodiment, the inorganic filler may be talcum powders, calcium carbonates, glass fibers, calcium carbonate fibers, tin oxides, or carbon blacks. In further embodiments, the inorganic filler may further selected from the group consisting of glass beads, calcium sulfates, barium sulfates, titanium dioxides, pearl powders, wollastonites, diatomites, kaolins, pulverized coals, pottery clays, micas, oil shale ashes, aluminosilicates, aluminas, carbon fibers, silicon dioxides, zinc oxides, and combinations thereof, particularly those without harmful elements (Cr, etc) to the environment and human health. The inorganic filler may be about 1 wt % to about 70 wt % of the plastic substrate.

Irradiation

In an illustrative, non-limiting, embodiment, a surface of the plastic substrate is irradiated to expose at least a first accelerator. In an embodiment, irradiation may be achieved by exposing a portion of the surface of the plastic substrate by laser radiation. In an embodiment, a sufficient portion of the surface of the plastic substrate may be irradiated, optionally by laser, to expose at least one accelerator, and alternatively a plurality of accelerators. The laser instrument may be an infrared laser, such as a $CO_2$ laser marking system, or a green laser marking machine. In a non-limiting embodiment, the laser may have a wavelength ranging from about 157 nanometers to about 10.6 microns, alternatively between about 500 nanometers and about 1000 nanometers, alternatively about 532 nanometers; a scanning speed of about 500 millimeters per second to about 8000 millimeters per second; a scanning step of about 3 microns to about 9 microns; a delaying time of about 30 microseconds to about 100 microseconds; a frequency of about 10 kilohertz to about 60 kilohertz, alternatively between about 30 kilohertz to about 40 kilohertz; a power of about 3 watt to about 4 watt; and a filling space of about 10 microns to about 50 microns. According to various embodiments of the present disclosure, the power of the laser may be sufficiently great to expose at least one accelerator, and alternatively a plurality of accelerators, but not so strong as to alter or damage the accelerators, or reduce the accelerators to metals.

In a non-limiting embodiment, the plastic substrate may have a thickness of about 500 microns, or more, and the depth of the irradiated portion of the plastic substrate may be about 20 microns, or less. In an embodiment, the areas without accelerators are not irradiated, and, without wishing to be bound by the theory, Applicant believes that those areas may have low deposition speed and poor adhesion. While, a few metals may deposit in these areas they may be easily removed by, for example and without limitation, ultrasonic cleaning. In this manner, Applicant believes, without wishing to be bound by such, that the metalization may be controlled in required areas in the surface of the plastic substrate.

In a further illustrative, non-limiting embodiment, a flowing device may be applied to remove any mist generated, or introduced, during the irradiation process in the un-irradiated areas. Additionally, in various non-limiting embodiments, the plastic substrate may be ultrasonically cleaned after laser irradiation.

In further illustrative, non-limiting embodiments, the accelerator, or metal elements within the accelerator, such as for example copper, may have a first valence state prior to irradiation and a second valence state after irradiation. In an embodiment, the first and second valence states may be the same, or are otherwise generally unaffected by the irradiation step of the present disclosure.

First Plating

In an embodiment, after irradiation the accelerators may be exposed in the surface of the plastic substrate. A copper and/or nickel plating may be introduced onto at least some of the accelerators. Without wishing to be bound by the theory, Applicant believes that introducing the copper and/or nickel plating onto at least some of the accelerators may result in a strong relatively adhesion between the plastic substrate and the plating layers.

In a non-limiting embodiment, after laser irradiation the accelerator(s) may be exposed in the irradiated areas. Thereafter, copper-plating or nickel-plating may be applied to the accelerator(s). The copper-plating and nickel-plating are generally known to those of ordinary skill in the art, and may include contacting the irradiated plastic substrate with a copper-plating or a nickel-plating bath (described below). Without wishing to be bound by the theory, Applicant believes that the exposed accelerators may favor the copper or nickel ions, to be reduced to copper or nickel powders, which may cover the surface of the accelerators, and form a dense copper layer or nickel layer rapidly on the accelerators.

Further Plating

In a non-limiting embodiment, following the first plating, one or more chemical, or electroplating, layers may be applied to the copper layer or nickel layer, or plate. For example, after a first nickel layer, or plating, may be formed on the surface(s) of the accelerator(s), a copper layer, or plating, may be chemical plated on the first nickel layer, or plate, and then a second nickel layer, or plate, may be chemically plated on the copper layer, or plate, to form a composite plastic article, having a layer, or plate, structure of Ni—Cu—Ni. Alternatively, an aurum layer may be flash layered, or plated, on the composite plastic article to form a plastic article having a layer, or plate, structure of Ni—Cu—Ni—Au.

In a further illustrative, non-limiting, embodiment, after a first copper layer, or plating, is formed on the surface(s) of the accelerator(s), a nickel layer, or plate, may be plated on the first copper layer, or plate, to form a layer, or plate, structure of Cu—Ni. Alternatively, an aurum layer may be flash layered, or plated, on the Cu—Ni layer, or plate, to form a layer, or plate, structure of Cu—Ni—Au.

In various non-limiting embodiments, the nickel layer, or plate, may have a thickness ranging from about 0.1 microns to about 50 microns, alternatively from about 1 micron to about 10 microns, and alternatively from about 2 microns to about 3 microns. The copper layer, or plate, may have a thickness ranging from about 0.1 microns to about 100 microns, alternatively from about 1 microns to about 50 microns, and alternatively from about 5 microns to about 30 microns. The aurum layer may have a thickness ranging from about 0.01 microns to about 10 microns, alternatively from about 0.01 microns to about 2 microns, and alternatively from about 0.1 microns to about 1 microns.

Chemical plating baths, electric solutions, and flash plating baths are generally known to those with ordinary skill in the art. In a non-limiting embodiment, the chemical plating bath for copper plating may comprise a copper salt and a reducer, with a pH value ranging from about 12 to about 13, wherein the reducer may reduce the copper ion to copper. The reducer may be selected from the group consisting of glyoxylic acids, hydrazines, sodium hypophosphites, and combinations thereof. In another embodiment, the chemical plating bath for copper plating may comprise 0.12 moles per liter ("mol/L") $CuSO_{4.5}H_2O$, 0.14 mol/L $Na_2EDTA.2H_2O$, 10 mol/L potassium ferrocyanide, 10 mg/L (milligram per liter) potassium ferrocyanide, 10 mg/L 2,2' bipyridine, and about 0.10 mol/L of glyoxylic acid (HCOCOOH), the bath having a pH of about 12.5 to about 13 adjusted by NaOH and $H_2SO_4$ solutions. In a non-limiting embodiment, the copper plating time may range from about 10 minutes to about 240 minutes. The chemical plating bath for nickel plating may comprise 23 grams per liter ("g/L") nickel sulfate, 18 g/L inferior sodium phosphate, 20 g/L lactic acid, 15 g/L malic acid, the bath having a pH of about 5.2 adjusted by a NaOH solution, and a temperature of about 85° C. to about 90° C. In a non-limiting embodiment, the nickel plating time may range from about 8 minutes to about 15 minutes. Without wishing to be bound by the theory, Applicant believes that nanometer copper oxide powders, having average diameters of about 40 nanometers, may greatly improve the speed of metal atoms deposition in the bath. Further, without wishing to be bound by the theory, Applicant believes that electrical plating is preferable, over chemical plating, when plating a relatively thick layer of copper.

Aurum flash plating is generally known to those with ordinary skill in the art. In a non-limiting embodiment, the flash plating bath may be a BG-24 neutral aurum bath, which is commercially available from Shenzhen Jingyanchuang Chemical Company, located in Shenzhen, China.

The following examples provide additional details of some embodiments of the present disclosure:

Example 1

In the first example:

a) $CaCuTi_4O_{12}$ was milled in an high speed ball grinder for 10 hours to form powders having an average diameter of about 700 nanometers, the powders were identified by XRD instrument; then PPE/PPS resin alloy, $CaCuTi_4O_{12}$ powders, calcium carbonate fiber, and antioxidant 1010 were mixed in a weight ratio of 100:10:30:0.2 in a high speed mixer to prepare a mixture; the mixture was then granulated and then injection molded to form an plastic substrate for a circuit board;

b) a metal circuit diagram was curved in the plastic substrate with a DPF-M12 infrared laser, available from TIDE PHARMACEUTICAL CO., LTD, located in Beijing, China. The laser had a wavelength of 1064 nanometers, a scanning speed of 1000 millimeters per second, a step of 9 microns, a delaying time of 30 microseconds, a frequency of about 40 kilohertz, a power of 3 watt, and a filling space of 50 microns; the surface of the plastic substrate was then ultrasonically cleaned; c) the plastic substrate was immersed in a nickel plating bath for 10 minutes to form a nickel layer having a thickness of 3 microns on the accelerators; the plastic substrate was immersed in a copper plating bath for 4 hours to form a copper layer having a thickness of 13 microns on the nickel layer; thereafter, the plastic substrate was immersed in a nickel plating bath for 10 minutes to form a nickel layer having a thickness of 3 microns on the copper layer; then the plastic substrate was flash plated with an aurum layer having a thickness of 0.03 microns on the nickel layer; where the nickel plating bath comprised 0.12 mol/L CuSO4.5H2O, 0.14 mol/L Na2EDTA.2H2O, 10 mg/L potassium ferrocyanide, 10 mg/L 2,2' bipyridine, 0.10 mol/L glyoxylic acid, having a pH of from 12.5 to 13, which was adjusted by NaOH and H2SO4 solutions; the nickel plating bath comprised 23 g/L nickel sulfate, 18 g/L inferior sodium phosphate, 20 g/L lactic acid, 15 g/L malic acid, the bath had a PH value of about 5.2; the flash plating bath was BG-24 neutral aurum bath, which was obtained from SHENZHEN JINGYANCHUANG CHEMICAL COMPANY, located in Shenzhen, China; the plastic substrate was formed into a plastic article for a circuit board.

Example 2

In a second example, the plastic article was prepared in the same manner as in EXAMPLE 1, with the following exceptions:

In step a) $CuNiTi_2O_6$ was milled to form powders with an average diameter of about 800 nanometers, the powders were identified by XRD instrument; PEEK resin, $CuNiTi_2O_6$, glass fiber, and antioxidant 168 were mixed at a weight ratio of 100:20:30:0.2 in a high speed ball grinder to prepare a mixture; the mixture was granulated; the granulated mixture was injection molded to form a plastic substrate for an electronic connector shell;

In step c) the plastic substrate was immersed in a nickel plating bath for 8 minutes to form a nickel layer with a thickness of 2 microns on the accelerators; the plastic substrate was then immersed in a copper plating bath for 3 hours to form a copper layer with a thickness of 13 microns on the nickel layer; the plastic substrate was then immersed in a nickel plating bath for 10 minutes to form a nickel layer with a thickness of 3 microns on the copper layer; then the plastic substrate was flash plated with an aurum layer having a thickness of 0.03 microns on the nickel layer to form a plastic article for an electronic connector shell.

Example 3

In the third example, the plastic article was prepared in the same manner as in EXAMPLE 1, with the following exceptions:

In step a) $CuNbO_3$ was milled to form powders with an average diameter of about 800 nanometers, the powders were identified by XRD instrument; PES resin, CuNbO3, potassium titanate whisker, antioxidant 1010, and polyethylene wax were mixed at a weight ratio of 100:10:30:0.2:0.1 in a high speed ball grinder to prepare a mixture, which was then granulated; the granulated mixture was then injection molded to form a plastic substrate for an electronic connector shell;

In step c) the plastic substrate was immersed in a copper plating bath for 3 hours to form a copper layer with a thickness of 5 microns on the accelerators; the plastic substrate was then immersed in a nickel plating bath for 10 minutes to form a nickel layer with a thickness of 3 microns on the copper layer to form a plastic article for an electronic connector shell.

Example 4

In the fourth example, the plastic article was prepared in the same manner as in EXAMPLE 1, with the following exceptions:

In step a) $CuTiO_3$ was milled to form powders with an average diameter of about 900 nanometers, the powders were identified by XRD instrument; PC resin, $CuTiO_3$, antioxidant 1076, and polyethylene wax were mixed with weight ratios of 100:20:0.2:0.1 in a high speed ball grinder to prepare a mixture; the mixture was granulated, and then flow molded to form a plastic substrate for an electronic connector shell;

In step c) the plastic substrate was immersed in a nickel plating bath for 10 minutes to form a nickel layer with a thickness of 3 microns on the accelerators; the plastic substrate was then immersed in a copper plating bath for 2 hours to form a copper layer with a thickness of 10 microns on the nickel layer; the plastic article was then immersed in a nickel plating bath for 12 minutes again to form a nickel layer with a thickness of 4 microns on the copper layer to form a plastic article for an electronic connector shell.

Example 5

In the fifth example, the plastic article was prepared in the same manner as in EXAMPLE 1, with the following exceptions:

In step a) $CuZrO_3$ was milled to form powders with an average diameter of about 900 nanometers, the powders were identified by XRD instrument; PPO resin, $CuZrO_3$, calcium carbonate fiber, antioxidant 1076, and polyethylene wax were mixed at a weight ratio of 100:10:10:0.2:0.1 in a high speed ball grinder to prepare a mixture; the mixture was granulated, and injection molded to form a plastic substrate for a connector shell of a solar cell;

In step c) the plastic substrate was immersed in a nickel plating bath for 8 minutes to form a nickel layer with a thickness of 2 microns on the accelerators; the plastic article was then immersed in a copper plating bath for 4 hours to form a copper layer with a thickness of 15 microns on the nickel layer; the plastic article was then immersed in a nickel plating bath for 10 minutes again to form a nickel layer with a thickness of 3 microns on the copper layer; then the plastic substrate was flash plated with an aurum layer having a thickness of 0.03 microns on the nickel layer to form the plastic article for a connector shell of a solar cell.

Example 6

In the sixth example:

a) 2.2 grams of $Na_2CO_3$, 98 grams of $CaCO_3$, 240 grams of CuO, 330 grams of $TiO_2$ powders were mixed; the powders were milled in a high speed ball grinder for 12 hours to form a mixture; the mixture was dried and calcinated under a temperature of 950° C. for 2 hours, and then milled again for 4 hours; the mixture was then dried and granulated with PVA powders, and pressed into a circular sheet under a pressure of 100 MPa; the sheet was calcinated under a temperature of 1100° C. for 6 hours to form powders; the powders were milled until the average diameter reached 900 nanometers; the resulting product, $Na_{0.04}Ca_{0.98}Cu_3Ti_4O_{12}$, was identified by XRD instrument.

b) PA6T resin, $Na_{0.04}Ca_{0.98}Cu_3Ti_4O_{12}$, antioxidant 1076, and polyethylene wax were mixed at a weight ratio of 100:10:0.2:0.1 to form a mixture; the mixture was granulated and injection molded into a plastic substratefor an electronic connector shell of an engine;

c) a metal circuit diagram was curved on the plastic substrate in a step substantially similar to step b) of EXAMPLE 1;

d) the plating step comprised: immersing the plastic substrate in a nickel plating bath for 8 minutes to form a nickel layer with a thickness of 2 microns on the accelerators; immersing the plastic substrate in a copper plating bath for 4 hours to form a copper layer with a thickness of 15 microns on the nickel layer; immersing the plastic substrate in a nickel plating bath for 10 minutes to form a nickel layer with a thickness of 3 microns on the copper layer; flash plating the plastic substrate with an aurum layer having a thickness of 0.03 microns on the nickel layer to form the plastic article for an electric connector shell of an engine.

Example 7

In the seventh example:

a) 3.3 grams of $La_2O_3$, 100 grams of $Ca_2CO_3$, 240 grams of CuO, 330 grams of $TiO_2$ powders were mixed; the powders were milled in a high speed ball grinder for 12 hours to form a mixture; the mixture was dried and calcinated under a temperature of 950° C. for 2 hours, and then milled again for 4 hours; the mixture was then dried, granulated with PVA powders, and pressed into a circular sheet under a pressure of 100 MPa; the sheet was calcinated under a temperature of 1100° C. for 6 hours to form powders; the powders were milled until the average diameter reaching 1.0 microns; the resulting product, $Na_{0.01}Ca_{0.99}Cu_3Ti_4O_{12}$, was identified by XRD instrument;

b) PPS resin, $Na_{0.01}Ca_{0.99}Cu_3Ti_4O_{12}$, antioxidant 1076, and polyethylene wax were mixed at a weight ratio of 100:10:0.2:0.1 to form a mixture; the mixture was granulated and injection molded to form a plastic substrate for an electronic connector shell;

c) a metal circuit diagram was curved on the plastic substrate in a step substantially similar to step b) of EXAMPLE 1;

d) the plating step comprised: immersing the plastic substrate in a copper plating bath for 3 hours to form a copper layer with a thickness of 12 microns on accelerators; immersing the plastic substrate in a nickel plating bath for 10 minutes to form a nickel layer with a thickness of3 microns on the copper layer to form the plastic article for an electric connector shell.

Example 8

Figure 2:
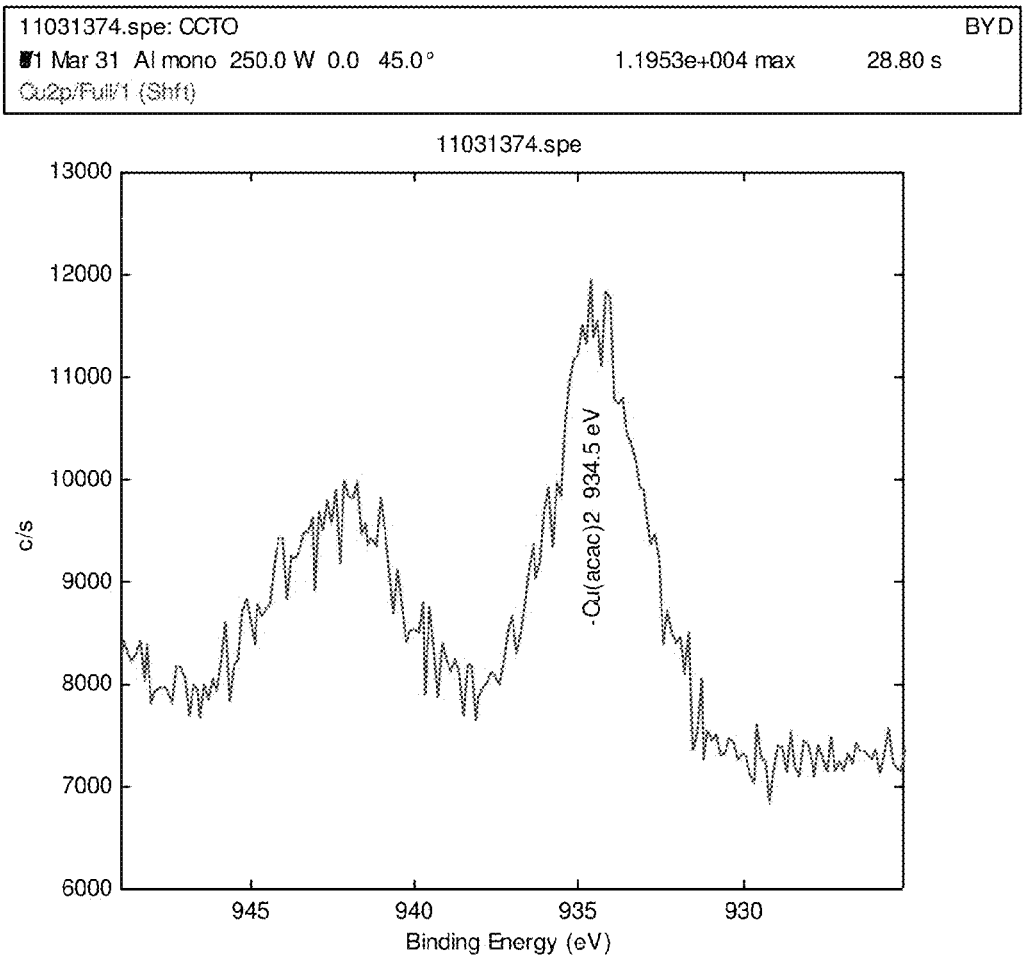
FIG. 2 is an alternative XPS pattern of the accelerator according to the embodiment of the present disclosure of FIG. 1.
Figure 3:
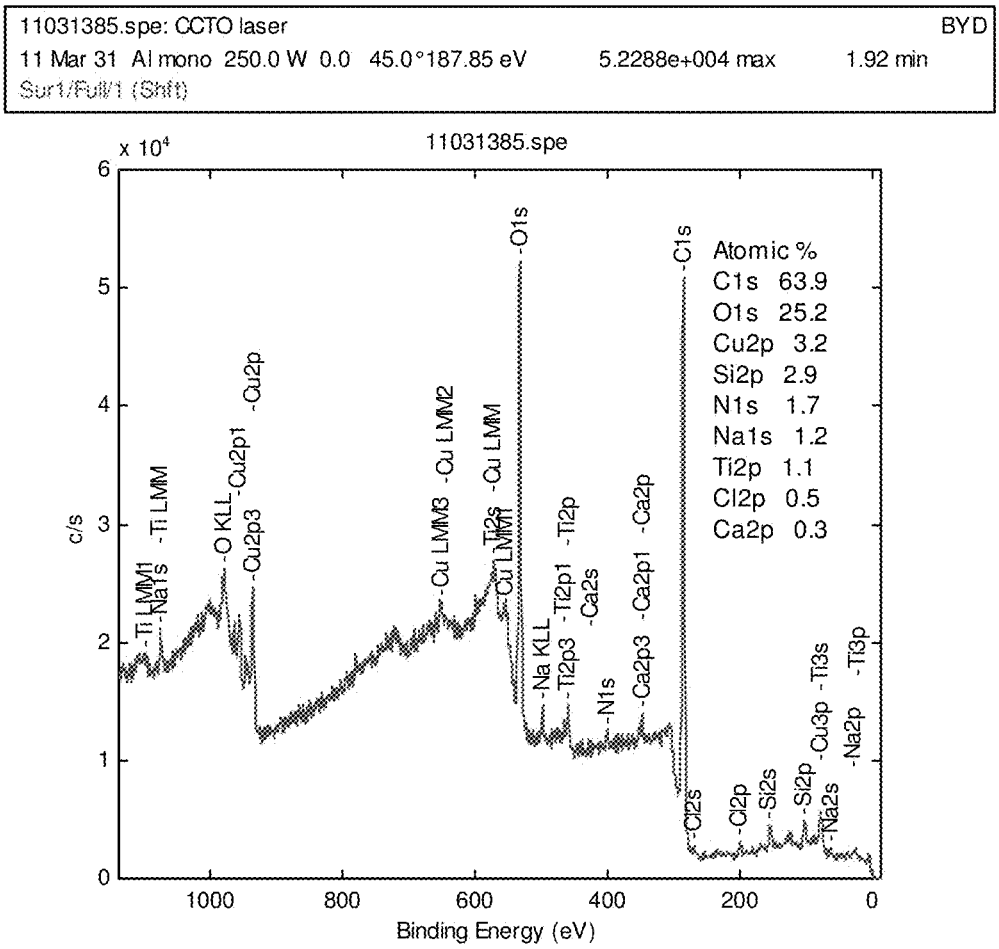
FIG. 3 is an XPS pattern of a plastic article according to an embodiment of the present disclosure
Figure 4:
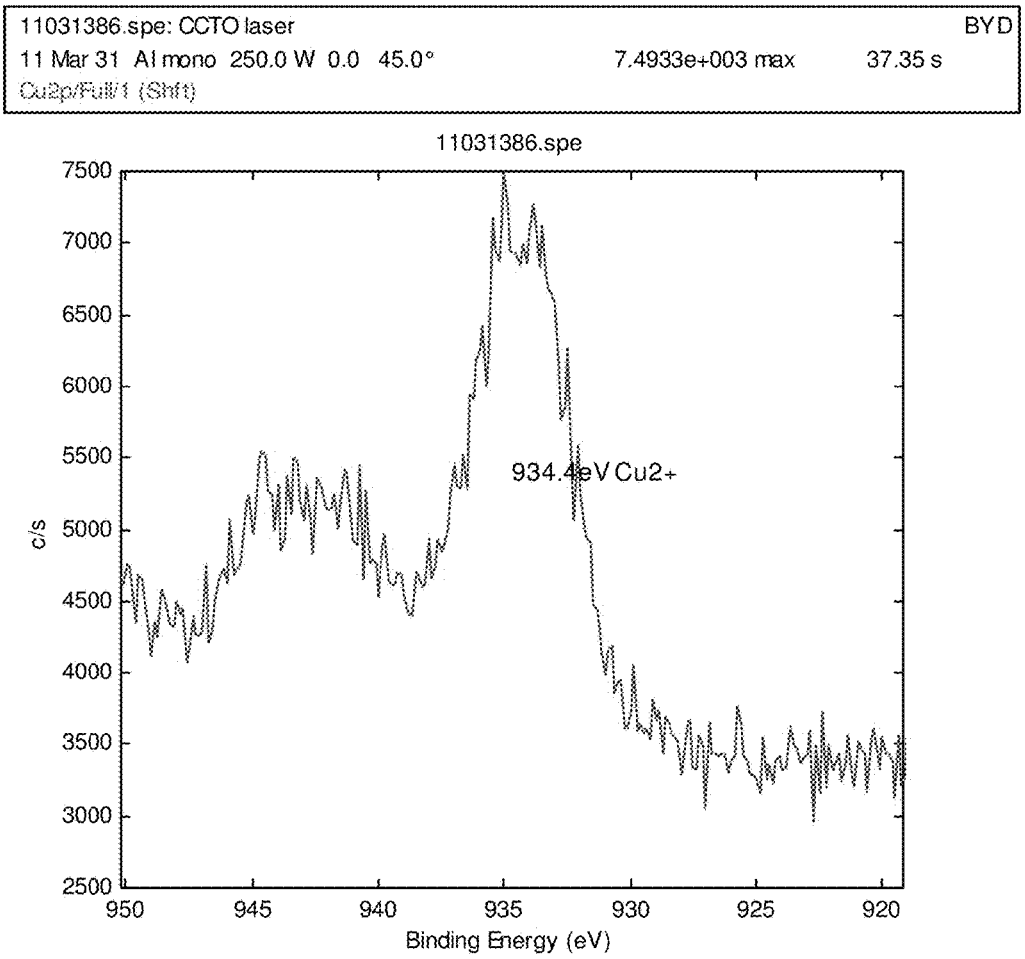
FIG. 4 is an alternative XPS pattern of the plastic article according to the embodiment of the present disclosure of FIG. 3.

In the eighth example:

a) $CaCuTi_4O_{12}$ was milled in an high speed ball grinder for 10 hours to form powders having an average diameter of about 700 nanometers, the powders were analyzed with XPS and XRD, and the XPS results are illustrated in FIGS. 1 and 2; then PPE/PPS resin alloy, $CaCuTi_4O_{12}$ powders, calcium carbonate fiber, and antioxidant 1010 were mixed in a weight ratio of 100:10:30:0.2 in a high speed mixer to prepare a mixture; the mixture was then granulated and then injection molded to form an plastic substrate for a circuit board;

b) a metal circuit diagram was curved in the plastic substrate with a DP-G15 green laser marking machine, available from Han's Laser Technology Co., Ltd, LTD, located in Shenzhen, China. The laser had a wavelength of 532 nanometers, a scanning speed of 1500 millimeters per second, a delaying time of 100 microseconds, a frequency of about 60 kilohertz, a power of 8 watt, and a filling space of 20 microns, and curved places of the plastic substrate were analyzed with XPS, and the XPS results are illustrated in FIGS. 3 and 4; the surface of the plastic article was then ultrasonically cleaned;

c) the plastic substrate was immersed in a nickel plating bath for 10 minutes to form a nickel layer having a thickness of 5 microns on the accelerators; the plastic substrate was immersed in a copper plating bath for 4 hours to form a copper layer having a thickness of 13 microns on the nickel layer; thereafter, the plastic substrate was immersed in a nickel plating bath for 10 minutes to form a nickel layer having a thickness of 3 microns on the copper layer; then the plastic substrate was flash plated with an aurum layer having a thickness of 0.03 microns on the nickel layer; where the nickel plating bath comprised 0.12 mol/L CuSO4.5H2O, 0.14 mol/L Na2EDTA.2H2O, 10 mg/L potassium ferrocyanide, 10 mg/L 2,2' bipyridine, 0.10 mol/L glyoxylic acid, having a pH of from 12.5 to 13, which was adjusted by NaOH and H2SO4 solutions; the nickel plating bath comprised 23 g/L nickel sulfate, 18 g/L inferior sodium phosphate, 20 g/L lactic acid, 15 g/L malic acid, the bath had a PH value of about 5.2; the flash plating bath was BG-24 neutral aurum bath, which was obtained from SHENZHEN JINGYANCHUANG CHEMICAL COMPANY, located in Shenzhen, China; the plastic substrate was formed into a plastic article for a circuit board.

Without wishing to be bound by the theory, Applicant believes that FIGS. 1, 2, 3 and 4 may illustrate that the valence state of copper did not change during the laser curving step.

Although the present disclosure have been described in detail with reference to several examples, additional variations and modifications exist within the scope and spirit as described and defined in the following claims.

What is claimed is:

1. A plastic article comprising: a plastic substrate having a plastic, at least one accelerator, and at least a first and a second metal layers plated on the at least one accelerator, the accelerator having a formula $ABO_3$, wherein A is one or more elements selected from Groups 9, and 10 of the Periodic Table of Elements, B includes one or more elements selected from Groups 4B and 5B of the Periodic Table of Elements, and O is oxygen.

2. The plastic article of claim 1, wherein the metal layers are selected from the group consisting of: Ni—Cu—Ni, or Ni—Cu—Ni—Au, or Cu—Ni, or Cu—Ni—Au.

3. The plastic article of claim 2, wherein the nickel layers each have a thickness ranging from about 0.1 microns to about 50 microns; the copper layers each have a thickness ranging from about 0.1 microns to about 100 microns; and the *aurum* layers each have a thickness ranging from about 0.01 microns to about 10 microns.

4. The plastic article of claim 1, wherein the accelerator has an average diameter ranging from about 20 nanometers to about 100 microns.

5. The plastic article of claim 1, wherein the amount of the accelerator ranges from about 1 wt % to about 40 wt % of the plastic substrate.

6. The plastic article of claim 1, wherein the plastic substrate further comprises at least one additive selected from the group consisting of: an antioxidant, a light stabilizer, a lubricant, and inorganic fillers.

7. The plastic article of claim 1, wherein A further includes one or more elements selected from Groups 1 and 2 of the Periodic Table of Elements and the lanthanide series of the Periodic Table of Elements.

8. A plastic article comprising: a plastic substrate having a plastic, at least one accelerator, and at least a first and a second metal layers plated on the at least one accelerator, the accelerator having a formula $ABO_3$, wherein A includes one or more elements selected from Groups 9, 10, and 11 of the Periodic Table of Elements, B includes one or more elements selected from Groups 4B and 5B of the Periodic Table of Elements, and O is oxygen; and wherein when A is Cu, the accelerator is selected from the group consisting of:

$Na_{0.04}Ca_{0.98}Cu_3Ti_4O_{12}$, $La_{0.01}Ca_{0.99}Cu_3Ti_4O_{12}$, $CuTiO_3$, $CuNiTi_2O_6$, $CuNbO_3$, $CuTaO_3$ and $CuZrO_3$.

* * * * *